US005158482A

United States Patent [19]

Tan et al.

[11] Patent Number: 5,158,482

[45] Date of Patent: Oct. 27, 1992

[54] USER CONFIGURABLE INTEGRATED ELECTRICAL CONNECTOR ASSEMBLY

[75] Inventors: Haw-Chan Tan; Nobbert N. Yu, both of Culver City, Calif.

[73] Assignee: Foxconn International, Inc., Sunnyvale, Calif.

[21] Appl. No.: 592,277

[22] Filed: Sep. 28, 1990

[51] Int. Cl.[5] ..... H01R 13/66

[52] U.S. Cl. ..... 439/620; 333/185

[58] Field of Search ..... 439/608, 620; 333/181-185

[56] References Cited

U.S. PATENT DOCUMENTS

| | | | |
|---|---|---|---|
| 3,710,285 | 1/1973 | Schor et al. | 439/608 |
| 3,764,943 | 10/1973 | Fort | 439/607 |
| 3,957,337 | 5/1976 | Damiano | 439/682 |
| 4,020,430 | 4/1977 | Vander Heyden | 439/620 |
| 4,215,326 | 7/1980 | Hollyday | 439/608 |
| 4,222,626 | 9/1980 | Hollyday et al. | 439/608 |
| 4,265,506 | 5/1981 | Hollyday | 439/608 |
| 4,296,389 | 10/1981 | Fuller et al. | 29/600 |
| 4,376,992 | 3/1983 | Aizawa | 368/156 |
| 4,589,720 | 5/1986 | Aujla et al. | 439/620 |
| 4,653,838 | 3/1987 | Ney et al. | 439/620 |
| 4,660,907 | 4/1987 | Belter | 439/108 |
| 4,679,013 | 7/1987 | Farrar et al. | 439/607 |
| 4,707,048 | 11/1987 | Gliha et al. | 333/185 |
| 4,710,710 | 12/1987 | Flora et al. | 165/11.2 |
| 4,804,332 | 2/1989 | Pirc | 439/620 |
| 4,846,732 | 7/1989 | Meelhuysen | 439/620 |
| 5,057,041 | 10/1991 | Yu et al. | 439/620 |
| 5,087,212 | 2/1992 | Hanami | 439/620 |
| 5,094,628 | 3/1992 | Kano | 439/620 |

*Primary Examiner*—Gary F. Paumen

[57] ABSTRACT

A user configurable integrated electrical connector assembly apparatus and method of using the electrical connector assembly to create a flexible manufacturing system are disclosed. The connector assembly is capable of being formed as a semi-finished product for inventory and at a later time may be simply and quickly reconfigured with insertable components to conform precisely to a customer's design specifications. The connector assembly includes an insulator defining a plurality of first passageways and a plurality of adjacent parallel passageways communicating with the first passageways over a portion of their length. A conductive shield surrounds the insulator and contacts the adjacent parallel passageways. The shield and the insulator can be bonded together to form a semi-finished product termed an intermediate connector assembly which may be stored in inventory and is easily and quickly reconfigured in accordance with a customer's design specifications by inserting chip type filter components such as capacitor, varistor or other electrical components into selected adjacent passageways.

2 Claims, 6 Drawing Sheets

USER CONFIGURABLE INTEGRATED ELECTRICAL CONNECTOR ASSEMBLY

BACKGROUND OF THE INVENTION

1. Field of the Invention

The present invention relates to electrical connector assemblies and particularly to a user configurable connector assembly capable of being formed as a semi-finished product for inventory. The connector assembly later can be configured to the specific design requirements of a customer by the simple insertion of desired filter components, conductive members and associated contacts into selected passageways. The connector assembly includes an integrated filter component for filtering or suppressing the effects of electromagnetic interference or high frequency and radio frequency interference. The connector described herein is a modification and improvement ,of a connector disclosed in copending application Ser. No. 07/544,106 filed 7-18-90 assigned to the same assignee as the present application.

2. The Prior Art

The invention described and illustrated herein is related to copending application Ser. No. 07/544,106 filed 7-18-90 owned by the owner hereof. Applicable portions of the description in that copending application are included herein by reference.

As explained in copending application Ser. No. 07/544,106, filed 7-18-90, that application discloses a specific type connector employing a chip type capacitor or other component. The aforementioned specification discloses the concept of manufacturing a semifinished product, an assembling procedure for a flexible manufacturing system, and user configuration of the ultimate product, and also discloses the concept of indirect communication between the contact and the capacitor, through an intermediate conductive member. The present invention offers a different type structure that is easier and simpler to produce, thus reducing the cost, but still retaining the advantages of that aforementioned invention disclosed in copending application Ser. No 07/554,106 filed 7-18-90. The prior art patents cited in the copending application, and the discussion related thereto, are included herein by reference.

SUMMARY OF THE INVENTION

The invention described and illustrated herein also provides a semi-finished product for a flexible manufacturing system and ultimate user configuration. It is an object of the present invention to provide a connector of lower cost and a connector more simple to manufacture.

The invention comprises an insulator defining a plurality of first passageways extending therethrough for receiving corresponding electrical terminal contacts. The insulator also defines a corresponding number of second passageways extending therethrough, and each second passageway is parallel to and communicates on one side with a first passageway over a portion of its length. Each second passageway has a longitudinal end for receiving a corresponding integrated electrical component, such as a capacitor. A conductive shield for shielding against electromagnetic interference covers the insulator and contacts the front openings of the second passageways.

In accordance with a customer's design specifications, a number of desired chip type filter components are inserted in selected ones of the second passageways.

A selected number of contacts are disposed in the corresponding first passageways. A corresponding number of conductive members are disposed individually in the second passageways behind and adjacent to the electrical filter components. Each conductive member is adapted for fixedly positioning and stabilizing an associated electrical filter component and holds the component firmly without welding or bonding to make the communication between the electrical filter component and the contact. At the same time each conductive member provides a means for preventing the transference of torsional forces or axial movement from the contact to the electrical component.

The user configurable integrated electrical connector assembly further includes a usage of flexible manufacturing system. A connector assembly may be assembled and stored as a semi-finished product. At a later time, and according to a customer's instructions, the producer can insert the desired electrical filter component corresponding to the customer's predetermined configuration into selected second passageways, then insert the conductive member behind each electrical component to fixedly position it in the same passageway. In a final step, the contacts are inserted into the first passageways. The invention together with further objects and attendant advantages, will be best understood with reference to the following detailed description taken in conjunction with the accompanying drawings.

DETAILED DESCRIPTION OF THE INVENTION

Figure 1:
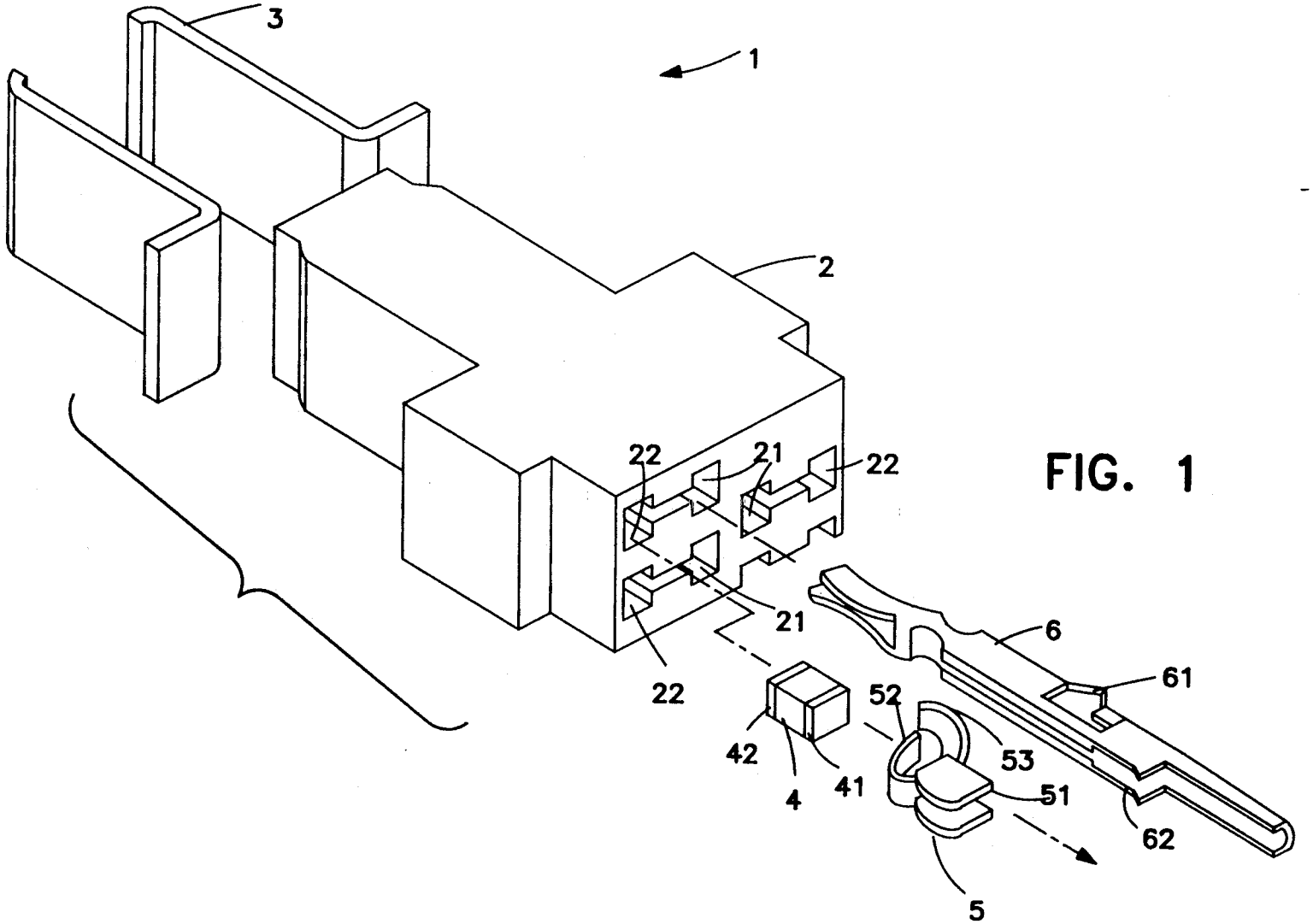
FIG. 1 is a perspective view of a presently preferred embodiment of the user configurable integrated electrical connector assembly of this invention.
Figure 2:
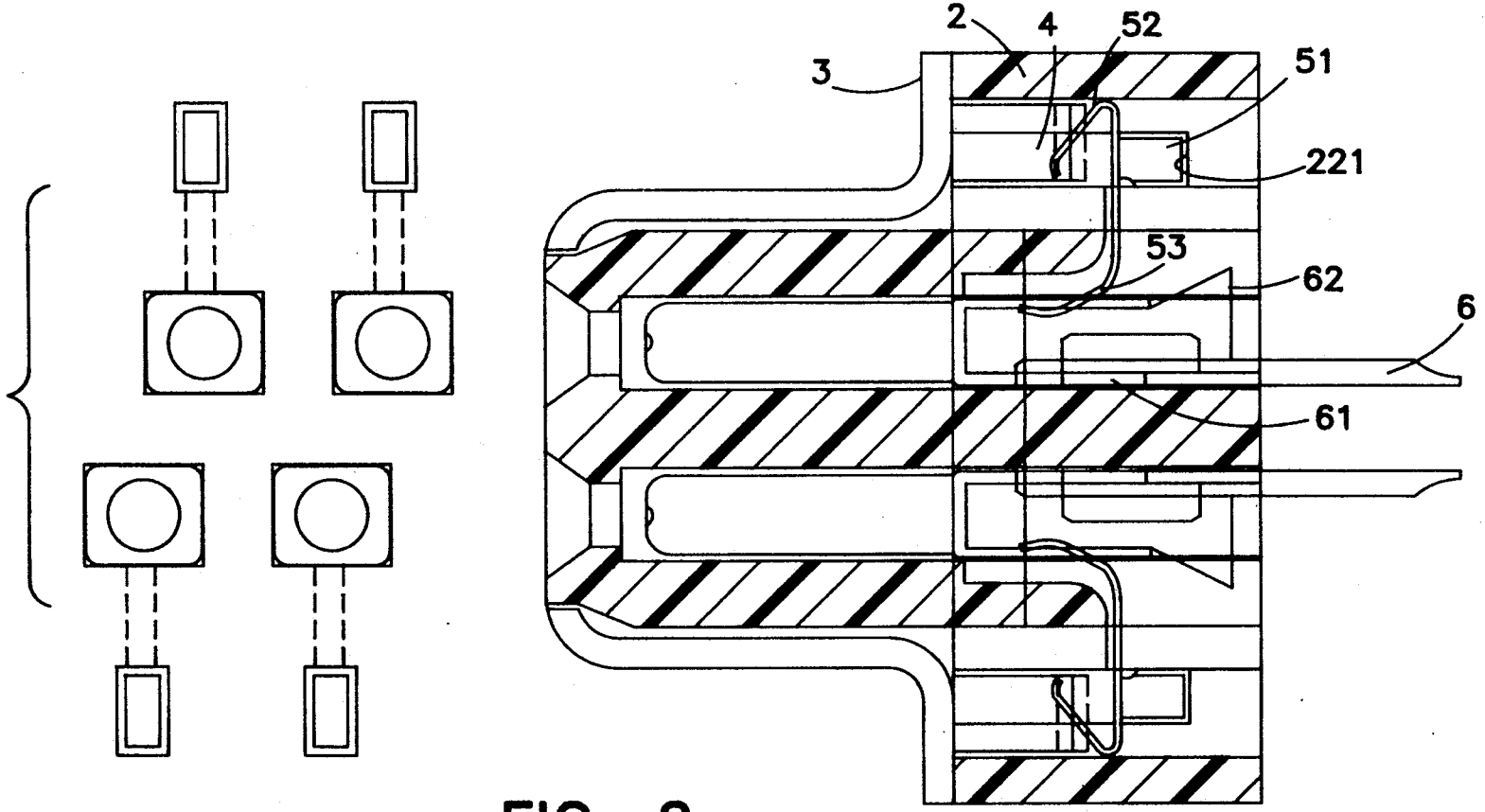
FIG. 2 is a vertical sectional view of the connector of FIG. 1.
Figure 3:
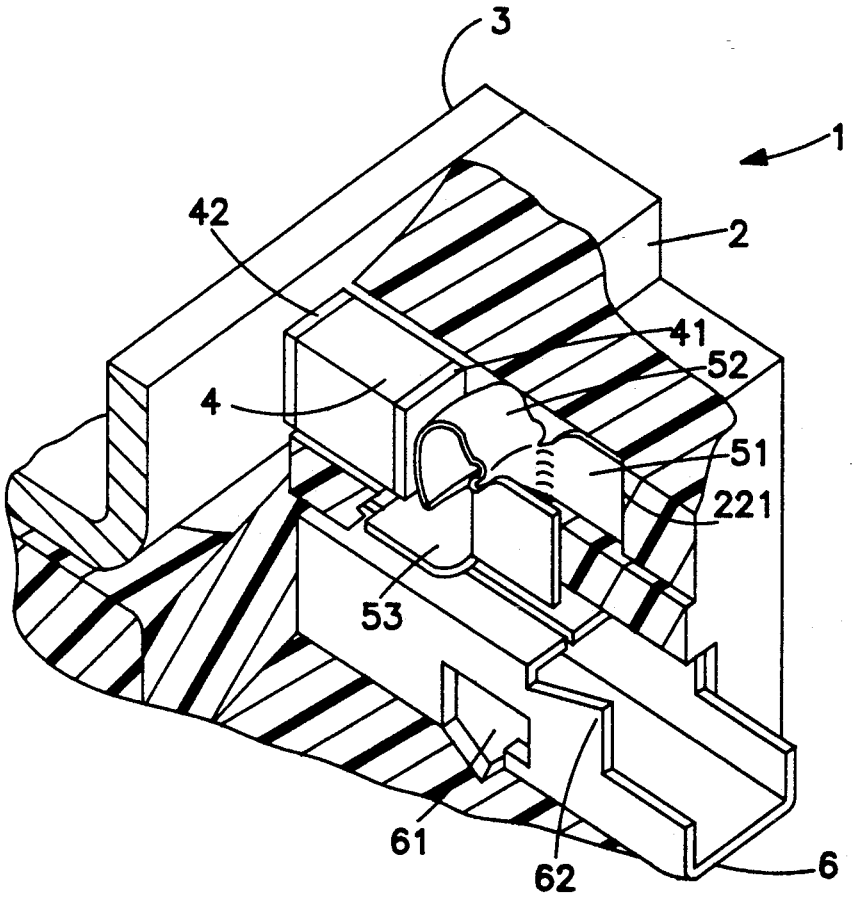
FIG. 3 is a cutaway perspective top view of the electrical contact, the capacitor, and the conductive member.

Referring to FIGS. 1, 2 & 3, the subject connector 1 includes an insulator 2 defining therethrough a plurality of first passageways 21 and a corresponding number of second passageways 22 parallel to first passageways 21. A conductive shield 3 engaging with the insulator 2 covers a portion of the surface of the insulator 2. The conductive shield 3 contacts the front opening of each second passageway 22 in order to make contact with a corresponding capacitor 4 disposed at the front end of each second passageway. A conductive member 5 is disposed behind the corresponding capacitor 4 in each second passageway 22. Contacts 6 are disposed in first passageways 21.

The contact 6 is composed of a conductive material and has a round cross-section in a first end portion and a square crosssection in a second end portion. In the second end portion of contact 6, there are two pairs of barbs on both side walls. Each horizontal barb 61 projects from the edge of the bottom, and the vertical one 62 projects from the edge of the top. The function of these two pairs of barbs is to pierce into the insulator 2 so that the contact 6 is fixed within the passageway 21 stably without any vertical or horizontal movement, including axially along passageway 21.

Conductive member 5 may be considered as being configured as two generally "U" shaped portions joined transversely with respect to one another at a common base. That is, a first horizontally extending outer surface 53 of the first "U" shaped portion is disposed against an adjacent parallel surface of a contact 6. The second outer surface 52 of the first "U" shaped portion is disposed resiliently against an electrode surface 41 of the electrical component 4 and is bent such that the second surface 52 forms another "U" shaped portion against the electrode surface 41. The second surface 52 is oriented obliquely to the first surface 53. The parallel outer surfaces 51 of the second "U" shaped portion are oriented transversely to the outer surfaces 52 and 53. The surfaces 51 extend outwardly against opposite sides of second passageway 22 to confront steps 221 (FIG. 3). Surfaces 51 provide means for completely stabilizing the conductive member 5 against rotational forces of the contact 6 and backward movement. Because component 4 contacts surface 52 of conductive member 5 only at an end surface 41 in a resilient, non-bonded manner, no rotational movement or torsional forces are transmitted from the contact 6 to the component 4.

It will be appreciated that there is no direct contact between the chip capacitor 4 and the electrical contact 6. This has the advantage over the other existing connectors of completely eliminating damage to the delicate chip capacitor or eliminating improper operation of the chip capacitor 4 or other chip component by reason of any axial movement of the contact 6. That is, while the electrical communication between the shield 3, chip capacitor 4, and contact 6 is maximized by conductive member 5, the danger of axial movement or torsional stress applied to the chip capacitor 4 by axial movement of the contact 6 is completely eliminated.

In summary, same as disclosed in copending application Ser. No. 07/544,106, the conductive member 5 has several advantages over the prior art mentioned in that pending patent. It provides an extremely efficient method both from a time and cost standpoint of enabling a chip capacitor or other filter component to be freely inserted in a connector and held in an invariant and maximized electrical communication with a shield and with a contact without soldering, bonding or laser welding. Accordingly, it is adapted to provide a flexible manufacturing system which enables a semifinished connector assembly to be stored in inventory and easily configured at a later date in accordance with a customer's precise specifications.

In the prior art mentioned in copending application Ser. No. 07/544,106, electrical components such as filtering capacitors which are soldered directly to the contacts or otherwise are disposed in a transverse direct contacting relationship with the contact, are subject to severe stain or deformation as a result of vibration or applied compressive or torsional forces which are transmitted directly through the contact. Capacitors may even be damaged when contacts are improperly inserted into the passageways of prior art connectors. The problem of strain or damage due to deformation is especially significant when a small and delicate component such as a chip capacitor must be precisely aligned in order to provide good electrical contact. The present invention completely eliminates the problems of strain and damage to delicate chip components due to axial movement of the contact.

In accordance with another aspect of this invention, it provides a flexible manufacturing system for enabling separate assembly of an initial "connector assembly" and a final customer configuration of a connector in accordance with each customer's own unique design specifications. The flexible manufacturing and assembly procedure may be considered a two-stage process. Initially, the connector assembly is formed as a semi-finished product which may be stored in inventory. Secondly, in accordance with a customer's design specifications, various chip components and contacts simply may be selectively inserted into the connector assembly in a predetermined configuration in order to provide a completely manufactured connector having a configuration which may be precisely determined by the customer. The second stage of customer configuration is accomplished simply and inexpensively from inventory components without the need for bonding, welding or soldering.

The assembly procedure for the connector of the present invention is described as follows.

(1) The conductive shield 3 is bonded by any suitable adhesive or bonding means to the insulator 2 to form an intermediate "connector assembly".

The connector assembly is deemed the semi-finished product of the flexible manufacturing system. The connector assembly is stored in inventory for subsequent customer configuration in accordance with a customer's unique design specification.

When the manufacturer receives instructions from the customer concerning the precise configuration of the connector, the following steps are followed consecutively in producing the customized connector from the semi-finished product.

(2) A specified chip capacitor 4 or other filter component is inserted into the selected passageways 22 in the insulator 2.

(3) Conductive members 5 are then inserted into the selected passageways 22 until the electrode end 42 of the capacitor 4 touches the corresponding portion of the shield 3. When this occurs, the projections 51 pass the steps 221 of the passageway 22 and spring out to confront the steps 221 rearwardly. This fixedly retains the chip capacitor 4 or other component without welding or bonding and provides a substantially invariant and maximized electrical communication between the shield 3 and the contact 6. The conductive member 5 also advantageously provides a means for eliminating the transmission of torsional forces from the contact 6 and thus prevents damage and improper operation to be anticipated even by a slight possible axial movement of the contact 6 as set forth above.

(4) Contacts 6 are then inserted into passageways 21 of insulator 2. When each contact 6 reaches its designated position, two pairs of barbs 61, 62 will pierce into the insulator 2. Thus, contact 6 is retained solidly in the passageways 21.

Upon insertion of the contacts 6 in step 4 above, the product is completely finished.

Figure 4:
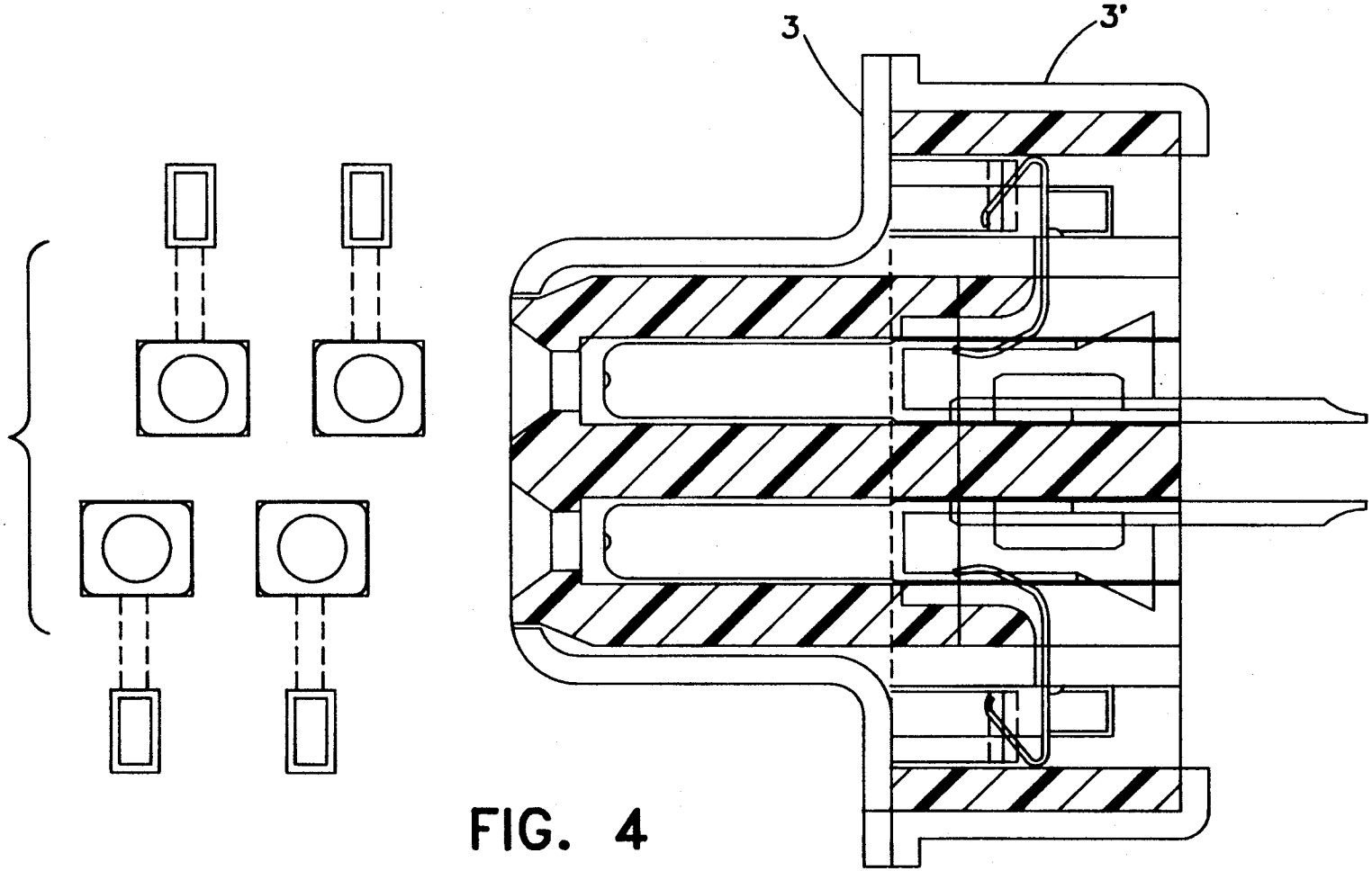
FIG. 4 is a vertical sectional view of another embodiment of the connector.

In an alternate embodiment, for the convenience of assembling, the insulator 2 can be formed by two pieces, the front insulator and the rear insulator divided by an imaginary line along the right edge surface as shown by the broken line in FIG. 4. Similarly, the conductive shield 3 can further include another extension portion 3' extending in the direction of the passageways direction to cover the front insulator aforementioned.

Figure 5:
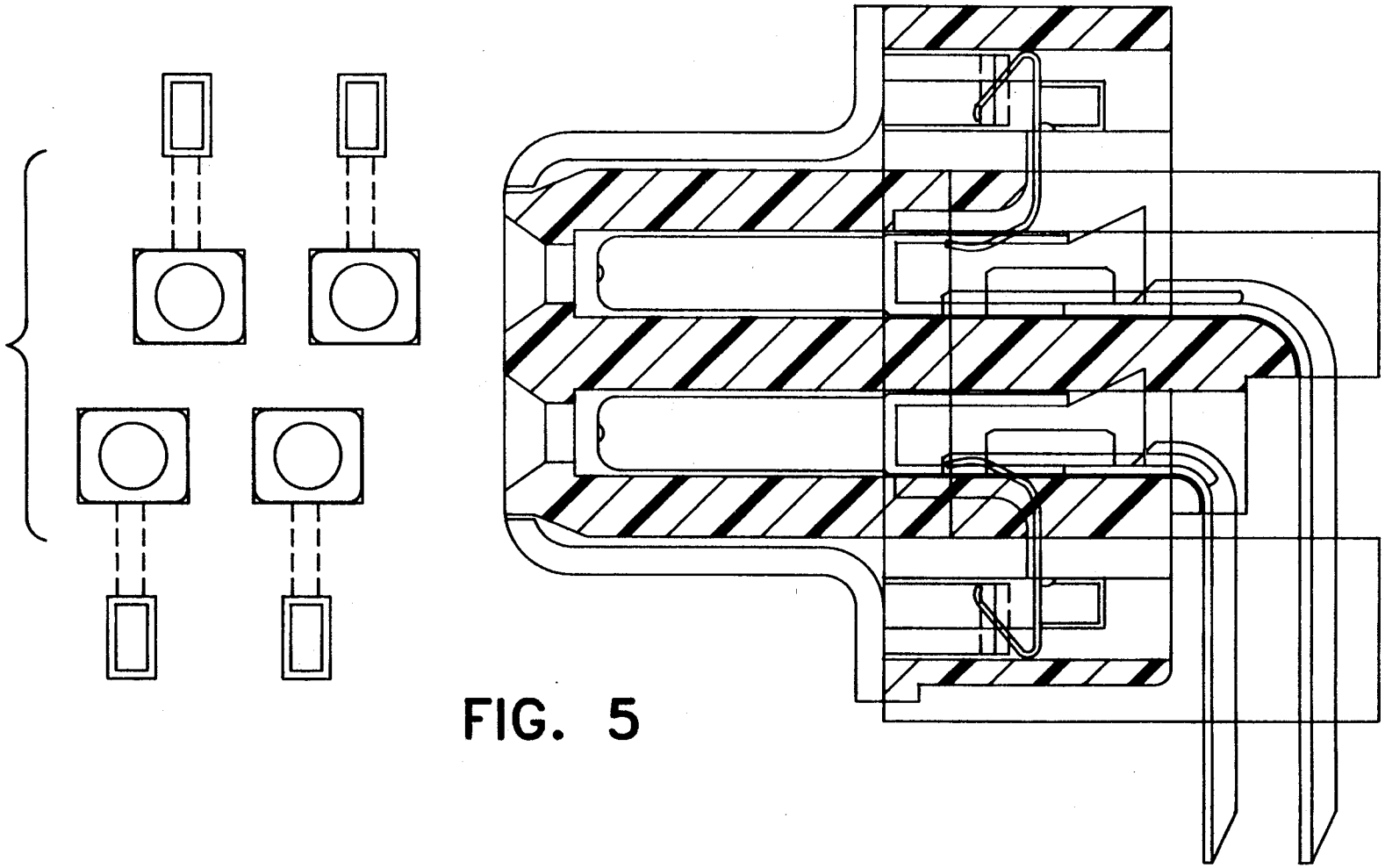
FIG. 5 is another preferred embodiment of right angle connector.

It will be appreciated that the passageways 21 of the insulator 2 enable the contact 6 to be inserted in an "upside down" position therein because the structure of the passageway is symmetrical at both the left and right sides. It may be convenient to insert the contact 6 in an inverse direction because the contacts of two rows are opposite to each other in the solder-type cup connectors but are identical in a right angle-type connector as shown in FIG. 5.

Further, it will be appreciated that the chip capacitor 4 may be replaced by any other type of chip component, for example, resistors, varistors, diodes or the like. The invention also can replace some versatile components which originally may be mounted on a surface of a PC board, while maintaining the same function in the operation of an entire system.

As shown in FIG. 1, it will be appreciated that passageway 22 has a longitudinal opening on the front side and this has the advantage of enabling the passageway 22 to accommodate a wide variety of chip components.

Figure 6:
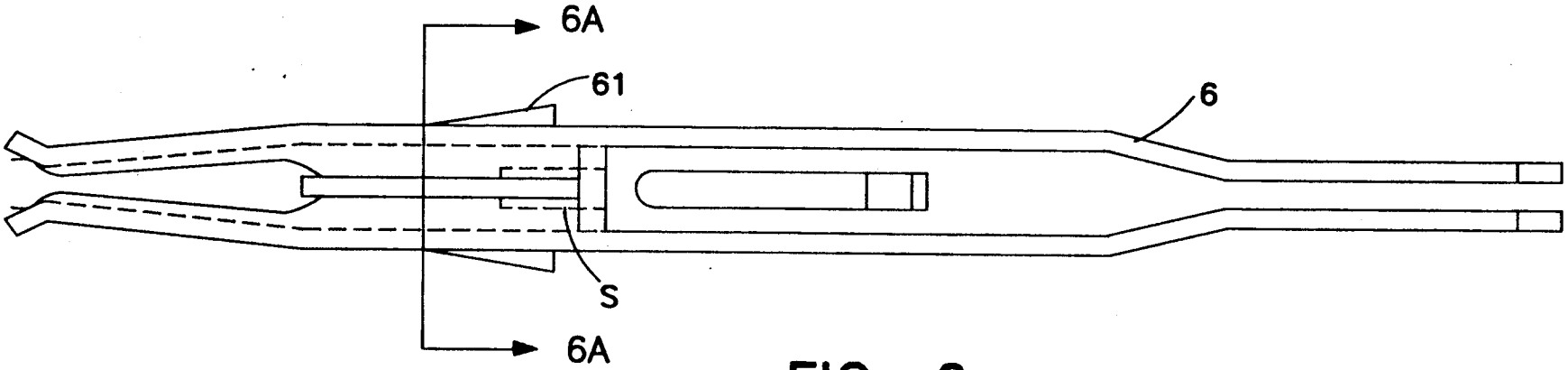
FIG. 6 is another preferred embodiment of the contact.
Figure 6A:
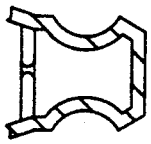
FIG. 6A is a vertical cross-sectional view taken in the plane indicated by the line 6A—6A in FIG. 6.

To improve flexibility of contact 5, the cross-sectional shape of the contact has a narrowed waist, as shown in FIG. 6A. For the same reason, adjacent the horizontal barbs there is provided a slot S positioned at the center line on the bottom to increase the spring property of the barbs so that it is easier to insert the contact while maintaining stiffness to prevent the contact from moving back when assembled.

The structure of the connector according to the present invention enables any number of passageways to be provided in the insulator. Four passageways are shown merely for the sake of illustration.

In conclusion, the details of the present invention provide a flexible manufacturing system wherein a producer need not store a great number of various types of connectors as inventory. The invention shortens the lead time necessary for customizing a connector because the connector may be manufactured as a semi-finished product in accordance with the flexible manufacturing system described herein. When the manufacturer has received a customer's order, the semi-finished product may be configured in accordance with a customer's exact design specification merely by inserting the contacts and capacitors or other desired chip components into corresponding passageways to provide a final product. This results in an extremely efficient method of flexible manufacturing from both a time and cost standpoint for configuring the final product. The present invention also provides a simpler and less expensive type filter connector than that of copending application Ser. No. 07/544,106. Only two pieces are required for a semi-finished product instead of originally more than three pieces. It can be deemed as a low cost type filter connector for basic use.

While the invention has been described in connection with what is presently considered to be the most practical and preferred embodiments, it is to be understood that the invention is not limited to the disclosed embodiment but, on the contrary, is intended to cover various modifications and equivalent arrangements included within the spirit and scope of the appended claims. For example, a separate rear insulator may be provided in order to enable different types of connectors to be configured, such as right angle type connectors, solder cup type connectors, or the like. The other elements need not be changed in order to provide these additional configurations. This is an advantage of the so called flexible manufacturing system provided by the present invention.

Therefore, persons of ordinary skill in this field are to understand that all such equivalent structures are to be included within the scope of the following claims:

What is claimed is:

1. A user configurable integrated electrical connector assembly comprising:

an insulator defining a plurality of first passageways extending therethrough and having an outer side;

a plurality of second passageways defined within said insulator and disposed in parallel with said first passageways, each second passageway communicating with an adjacent first passageway along a portion of its length, and each second passageway having a receiving end including an opening extending longitudinally through the outer side of said insulator;

a conductive shield covering said insulator and contacting the front opening of each second passageway;

a plurality of electrical components inserted into the receiving end of selected ones of said second passageways;

a plurality of contacts inserted into corresponding adjacent first passageways, each contact characterized by a round first end portion and a square second end portion having thereon at least one pair of barbs, wherein a cross-sectional shape of the square second end portion of said contact has a narrowed waist, and said second end portion of said contact has a bottom defining a center line thereon, a slot being positioned at said center line to increase the spring property of said contact and said barbs; and a plurality of corresponding conductive members inserted into said selected second passageways for providing improved electrical communication between said electrical components and said contacts, each conductive member including means for preventing transmission of torsional forces from a said contact to an associated said electrical component.

2. A user configurable integrated electrical connector assembly comprising:

a insulator defining a plurality of first passageways extending therethrough and having an outer side;

a plurality of second passageways defined within said insulator and disposed in parallel with said first passageways, each second passageway communicating with an adjacent first passageway along a portion of its length and each second passageway having a receiving end including an opening extending longitudinally through the outer side of said insulator, a step disposed in each second passageway for proper positioning of said conductive member inserted therein;

a conductive shield covering said insulator and contacting the front opening of each second passageways;

a plurality of electrical components inserted into the receiving end of selected ones of said second passageways;

a plurality of contacts inserted into corresponding adjacent first passageways, each of said contacts characterized by a round first end portion, and a square second end portion including a bottom defining a center line, having thereon a pair of barbs in horizontal direction and another pair in vertical direction, a slot positioned at the center line on the bottom and a cross-sectional shape of said square second end portion having a narrowed waist to increase the spring property of said contact and said barbs; and a plurality of corresponding conductive members inserted into said selected second passageways for providing improved electrical communication between said electrical components and said contacts, each of said conductive members including means for preventing transmission of torsional forces from a contact to an associated electrical component, and characterized by a right angle-like side configuration, a "U" shaped portion formed at an end thereof, a horizontal extension portion formed at the opposite end thereof, and a pair of projections extending rearwardly and outwardly from both opposite side edges.

* * * * *